US006955104B2

(12) United States Patent
Hu

(10) Patent No.: US 6,955,104 B2
(45) Date of Patent: Oct. 18, 2005

(54) REVERSIBLE RATCHETING TOOL WITH A SMALLER HEAD

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 231 days.

(21) Appl. No.: 10/187,870

(22) Filed: Jul. 1, 2002

(65) Prior Publication Data

US 2002/0166417 A1 Nov. 14, 2002

Related U.S. Application Data

(63) Continuation-in-part of application No. 09/523,625, filed on Mar. 13, 2000, now Pat. No. 6,457,387.

(51) Int. Cl.[7] ..... B25B 13/46
(52) U.S. Cl. ..... 81/63.2; 81/60; 81/63.1
(58) Field of Search ..... 81/63.2, 63.1, 81/63, 62, 61, 60

(56) References Cited

U.S. PATENT DOCUMENTS

| | | | |
|---|---|---|---|
| 15,482 | A | 8/1856 | Gilman |
| 726,012 | A | 4/1903 | Andrew |
| 810,599 | A | 1/1906 | Ansorge |
| 818,761 | A | 4/1906 | Hanes et al. |
| 841,686 | A | 1/1907 | Hatfield |
| 878,657 | A | 2/1908 | Munch |
| 893,097 | A | 7/1908 | Reams |
| 915,446 | A | 3/1909 | Kearnes |
| RE13,205 | E | 2/1911 | Lane |
| 1,033,358 | A | 7/1912 | Turner |
| 1,078,059 | A | 11/1913 | Mossberg |
| 1,090,578 | A | 3/1914 | Smythe |
| 1,194,471 | A | 8/1916 | Boosinger |
| 1,261,092 | A | 4/1918 | Allen |
| 1,382,492 | A | 6/1921 | Evans |
| 1,426,127 | A | 8/1922 | Tuttle |
| 1,601,767 | A | 10/1926 | Peterson |
| 1,614,039 | A | 1/1927 | Mandl |
| 1,639,078 | A | 8/1927 | Coe |
| 1,680,515 | A | 8/1928 | Gormley |
| 1,772,524 | A | 8/1930 | Seidemann |
| 1,957,462 | A | 5/1934 | Kress |
| 2,193,984 | A | 3/1940 | Rhinevault |

(Continued)

FOREIGN PATENT DOCUMENTS

| | | |
|---|---|---|
| DE | 373436 | 4/1923 |
| DE | 921198 | 7/1949 |

(Continued)

OTHER PUBLICATIONS

EPO Search Report for Appln. No. EP 00 12 6902 dated Feb. 17, 2003 (3p.) 0570.
Appeal Brief against Office Action on Opposition to Patent Application No. 089200570 P01 in Taiwan and translation of same.

(Continued)

*Primary Examiner*—Hadi Shakeri

(57) ABSTRACT

A ratcheting tool includes a handle, a head, and a drive member having a gear wheel rotatably mounted in a compartment of the head. An end of the drive member extends beyond the compartment. A pawl is mounted in the compartment and includes teeth for engaging with the teeth of the gear wheel. A switching plate is mounted to the end of the drive member and is pivotable between two positions. The switching plate includes a ring portion and a thumb piece. The ring portion includes a recessed portion, and a retainer is mounted on the recessed portion and partially engaged in an engaging groove in the end of the drive member. The thumb piece includes a protrusion on an underside thereof for engaging with a recess in the pawl such that the pawl is moved when the thumb piece is turned.

24 Claims, 12 Drawing Sheets

U.S. PATENT DOCUMENTS

| | | | | |
|---|---|---|---|---|
| 2,201,705 | A | | 5/1940 | Stone |
| 2,201,827 | A | | 5/1940 | Froeschl et al. |
| 2,317,461 | A | | 4/1943 | Jackson |
| 2,542,241 | A | | 2/1951 | Fors |
| 2,612,807 | A | | 10/1952 | Hunt |
| 2,657,604 | A | | 11/1953 | Rueb |
| 2,701,977 | A | | 2/1955 | Stone |
| 2,735,324 | A | * | 2/1956 | Goldwater et al. ..... 81/60 |
| 2,764,048 | A | | 9/1956 | Thompson |
| 2,769,360 | A | | 11/1956 | Cottrell et al. |
| 2,800,821 | A | | 7/1957 | Fruscella |
| 2,803,980 | A | | 8/1957 | Vogel |
| 2,891,434 | A | | 6/1959 | Lozensky |
| 2,957,377 | A | | 10/1960 | Hare |
| 2,978,081 | A | | 4/1961 | Lundin |
| 3,019,682 | A | | 2/1962 | Hare |
| 3,044,591 | A | | 7/1962 | Kilness |
| 3,233,481 | A | | 2/1966 | Bacon |
| 3,250,157 | A | | 5/1966 | Badger |
| 3,265,171 | A | | 8/1966 | Kilness |
| 3,269,496 | A | | 8/1966 | Kilness |
| 3,337,014 | A | | 8/1967 | Sandrick |
| 3,342,229 | A | | 9/1967 | Janes |
| 3,393,587 | A | | 7/1968 | Jolliff et al. |
| 3,393,780 | A | | 7/1968 | Kilness |
| 3,436,992 | A | | 4/1969 | Over et al. |
| 3,508,455 | A | | 4/1970 | Miller |
| 3,575,069 | A | | 4/1971 | White |
| 3,577,816 | A | | 5/1971 | Alexander et al. |
| 3,598,001 | A | | 8/1971 | Thomasian |
| 3,606,940 | A | | 9/1971 | Finkeldei |
| 3,691,876 | A | | 9/1972 | Cassidy, Jr. |
| 3,713,356 | A | | 1/1973 | Knudsen |
| 3,742,788 | A | | 7/1973 | Priest |
| 3,783,703 | A | | 1/1974 | Trimble et al. |
| 3,838,614 | A | | 10/1974 | O'Donnell |
| 3,866,492 | A | | 2/1975 | Knoll |
| 3,908,487 | A | | 9/1975 | Plaw |
| 3,970,155 | A | | 7/1976 | Otto |
| 4,053,037 | A | | 10/1977 | Solomon |
| 4,070,932 | A | | 1/1978 | Jeannotte |
| 4,111,077 | A | | 9/1978 | Cummings et al. |
| 4,128,025 | A | | 12/1978 | Main et al. |
| 4,147,076 | A | | 4/1979 | Wright et al. |
| 4,257,507 | A | | 3/1981 | Solomon |
| 4,274,311 | A | | 6/1981 | Ebert |
| 4,277,989 | A | | 7/1981 | Tracy |
| 4,277,990 | A | | 7/1981 | Hall |
| 4,308,768 | A | | 1/1982 | Wagner |
| 4,308,769 | A | | 1/1982 | Rantanen |
| 4,328,720 | A | | 5/1982 | Shiel |
| 4,336,728 | A | | 6/1982 | Diebert |
| 4,406,186 | A | | 9/1983 | Gummow |
| 4,420,995 | A | | 12/1983 | Roberts |
| 4,485,700 | A | | 12/1984 | Colvin |
| 4,488,460 | A | | 12/1984 | Ballone et al. |
| 4,512,218 | A | | 4/1985 | Chow |
| 4,520,697 | A | | 6/1985 | Moetteli |
| 4,631,988 | A | | 12/1986 | Colvin |
| 4,662,251 | A | | 5/1987 | Kohal |
| 4,709,600 | A | | 12/1987 | Mierbach et al. |
| 4,722,252 | A | | 2/1988 | Fulcher et al. |
| 4,722,253 | A | | 2/1988 | Chow |
| 4,762,033 | A | | 8/1988 | Chow |
| 4,770,072 | A | | 9/1988 | Neuhaus |
| 4,777,852 | A | | 10/1988 | Herman et al. |
| 4,796,492 | A | | 1/1989 | Liou |
| 4,807,500 | A | | 2/1989 | Main |
| 4,862,775 | A | | 9/1989 | Chow |
| 4,869,138 | A | | 9/1989 | Farris |
| 4,903,554 | A | | 2/1990 | Colvin |
| 4,924,737 | A | | 5/1990 | Gummow |
| 4,934,220 | A | | 6/1990 | Slusar et al. |
| 4,986,147 | A | | 1/1991 | Cooper |
| 4,991,468 | A | | 2/1991 | Lee |
| 5,000,066 | A | | 3/1991 | Gentiluomo |
| 5,012,705 | A | | 5/1991 | Chow |
| 5,038,452 | A | | 8/1991 | Beugelsdyk et al. |
| 5,076,121 | A | | 12/1991 | Fosella |
| 5,095,781 | A | | 3/1992 | Blake et al. |
| 5,144,869 | A | | 9/1992 | Chow |
| 5,157,994 | A | | 10/1992 | Krivec |
| 5,178,047 | A | | 1/1993 | Arnold et al. |
| 5,199,330 | A | | 4/1993 | Arnold et al. |
| 5,199,335 | A | | 4/1993 | Arnold et al. |
| 5,230,262 | A | | 7/1993 | Ahlund et al. |
| 5,231,903 | A | | 8/1993 | Bockman, Jr. |
| 5,233,891 | A | | 8/1993 | Arnold et al. |
| 5,271,300 | A | | 12/1993 | Zurbuchen et al. |
| 5,295,422 | A | | 3/1994 | Chow |
| 5,347,892 | A | | 9/1994 | Moetteli |
| 5,392,672 | A | | 2/1995 | Larson et al. |
| 5,404,773 | A | | 4/1995 | Norville |
| 5,425,291 | A | | 6/1995 | Chang |
| 5,448,931 | A | | 9/1995 | Fossella et al. |
| 5,467,672 | A | | 11/1995 | Ashby |
| 5,477,757 | A | | 12/1995 | Maresh |
| 5,495,783 | A | | 3/1996 | Slusar et al. |
| 5,499,560 | A | | 3/1996 | Aeschliman |
| 5,501,124 | A | | 3/1996 | Ashby |
| 5,509,333 | A | | 4/1996 | Rion |
| 5,522,288 | A | | 6/1996 | Slusar et al. |
| 5,533,427 | A | | 7/1996 | Chow |
| 5,535,646 | A | | 7/1996 | Allen et al. |
| 5,557,994 | A | | 9/1996 | Nakayama |
| 5,582,081 | A | | 12/1996 | Lin |
| 5,584,220 | A | | 12/1996 | Darrah et al. |
| 5,595,095 | A | | 1/1997 | Hillinger |
| 5,622,089 | A | | 4/1997 | Gifford, Sr. |
| 5,626,061 | A | | 5/1997 | Whitley |
| 5,626,062 | A | | 5/1997 | Colvin |
| 5,636,557 | A | | 6/1997 | Ma |
| 5,669,875 | A | | 9/1997 | van Eerdenburg |
| 5,709,137 | A | | 1/1998 | Blacklock |
| 5,749,272 | A | | 5/1998 | Phan |
| 5,782,147 | A | | 7/1998 | Chaconas et al. |
| 5,794,496 | A | | 8/1998 | Arnold |
| 5,829,326 | A | | 11/1998 | Richner |
| 5,842,391 | A | | 12/1998 | Chaconas |
| 5,857,390 | A | | 1/1999 | Whiteford |
| 5,873,286 | A | | 2/1999 | Van Lenten |
| 5,878,635 | A | | 3/1999 | Hsieh |
| 5,884,537 | A | | 3/1999 | Chen |
| 5,884,538 | A | | 3/1999 | Van Lenten |
| 5,887,493 | A | | 3/1999 | Main |
| 5,901,620 | A | | 5/1999 | Arnold |
| 5,910,197 | A | | 6/1999 | Chaconas |
| 5,911,798 | A | | 6/1999 | Arnold |
| 5,913,954 | A | | 6/1999 | Arnold et al. |
| 5,927,158 | A | | 7/1999 | Lin |
| 5,946,987 | A | | 9/1999 | Wei |
| 5,946,989 | A | | 9/1999 | Hsieh |
| 5,957,009 | A | | 9/1999 | McCann |
| 5,964,129 | A | | 10/1999 | Shiao |
| 5,970,552 | A | | 10/1999 | Kwiecien et al. |
| 5,979,274 | A | | 11/1999 | Hsieh |
| 5,996,453 | A | | 12/1999 | Blacklock |
| 6,000,302 | A | | 12/1999 | Chiang |
| 6,006,631 | A | | 12/1999 | Miner et al. |
| 6,044,731 | A | | 4/2000 | Hsieh |
| 6,065,374 | A | | 5/2000 | Taggart |

| | | | | |
|---|---|---|---|---|
| 6,125,722 | A | 10/2000 | Hopper, Jr. et al. | |
| 6,134,990 | A | 10/2000 | Ling et al. | |
| 6,134,991 | A | 10/2000 | Chaconas | |
| D433,896 | S | 11/2000 | Wei | |
| D434,292 | S | 11/2000 | Hsieh | |
| 6,148,695 | A | 11/2000 | Hu | |
| 6,152,826 | A | 11/2000 | Profeta et al. | |
| 6,155,140 | A | 12/2000 | Tsai | |
| 6,161,454 | A | 12/2000 | Chaconas | |
| 6,164,167 | A | 12/2000 | Chen | |
| 6,205,889 | B1 | 3/2001 | Hsieh | |
| 6,209,423 | B1 | 4/2001 | Shiao | |
| 6,216,563 | B1 | 4/2001 | Hsieh | |
| 6,216,567 | B1 | 4/2001 | Hu | |
| 6,220,123 | B1 | 4/2001 | Chen | |
| 6,230,591 | B1 | 5/2001 | Ling et al. | |
| 6,240,813 | B1 | 6/2001 | Hyatt | |
| 6,257,096 | B1 | 7/2001 | Ling | |
| 6,257,097 | B1 | 7/2001 | I-He | |
| 6,260,448 | B1 | 7/2001 | Chaconas | |
| 6,260,449 | B1 | 7/2001 | I-He | |
| 6,263,767 | B1 | 7/2001 | Hu | |
| 6,282,991 | B1 | 9/2001 | Hu | |
| 6,282,992 | B1 | 9/2001 | Hu | |
| 6,282,993 | B1 | 9/2001 | Forman et al. | |
| 6,301,998 | B1 | 10/2001 | Hu | |
| 6,308,594 | B1 | 10/2001 | Cheng | |
| 6,332,382 | B1 | 12/2001 | Anderson et al. | |
| 6,334,373 | B1 | 1/2002 | Hsieh | |
| 6,382,051 | B1 | 5/2002 | Chang | |
| 6,382,052 | B1 * | 5/2002 | Chen | 81/63 |
| 6,386,072 | B1 * | 5/2002 | Yuan-Chin et al. | 81/63.2 |
| 6,427,560 | B1 | 8/2002 | Shea | |
| 6,431,031 | B1 | 8/2002 | Hu | |
| 6,435,062 | B1 | 8/2002 | McCann | 81/63 |
| 6,435,063 | B1 | 8/2002 | Chen | 81/63.2 |
| 6,450,066 | B1 | 9/2002 | Hu | |
| 6,450,068 | B1 | 9/2002 | Hu | |
| 6,453,779 | B2 | 9/2002 | Hu | |
| 6,457,387 | B1 | 10/2002 | Hu | |
| 6,457,388 | B1 * | 10/2002 | Chen | 81/63.2 |
| 6,457,389 | B1 | 10/2002 | Hu | |
| 6,488,136 | B2 | 12/2002 | Chang | |
| 6,516,691 | B1 | 2/2003 | Wei | |
| 6,520,051 | B1 | 2/2003 | Hu | |
| 6,539,825 | B1 | 4/2003 | Lin | |
| 6,568,299 | B2 | 5/2003 | Hu | |
| 6,591,717 | B2 | 7/2003 | Wei | |
| 6,629,477 | B2 | 10/2003 | Ling et al. | |
| 6,644,148 | B2 | 11/2003 | Hu | |
| 6,647,832 | B2 | 11/2003 | Hu | |
| 6,662,693 | B2 | 12/2003 | Hu | |
| 6,666,112 | B2 | 12/2003 | Hu | |
| 6,666,117 | B2 | 12/2003 | Hu | |
| 6,688,195 | B1 | 2/2004 | Hsien | |
| 6,708,586 | B1 | 3/2004 | Chen | |
| 6,722,234 | B2 | 4/2004 | Hu | |
| 6,732,614 | B2 | 5/2004 | Hu | |
| 6,745,647 | B2 | 6/2004 | Wang | |
| 6,748,825 | B2 | 6/2004 | Hsu | |
| 6,758,641 | B2 | 7/2004 | Hu | |
| 6,761,092 | B2 | 7/2004 | Hsien | |
| 2001/0035074 | A1 | 11/2001 | Hu | |
| 2002/0017169 | A1 | 2/2002 | Hu | |
| 2002/0023519 | A1 | 2/2002 | Hu | |
| 2002/0023520 | A1 | 2/2002 | Hu | |
| 2002/0026858 | A1 | 3/2002 | Hu | |
| 2002/0062718 | A1 | 5/2002 | Wang | |
| 2002/0088312 | A1 | 7/2002 | Ling et al. | 81/63.2 |
| 2002/0112573 | A1 | 8/2002 | Hu | 81/63.2 |
| 2002/0162423 | A1 | 11/2002 | Hu | |
| 2002/0162424 | A1 | 11/2002 | Hu | |
| 2002/0166416 | A1 | 11/2002 | Hu | |
| 2002/0166417 | A1 | 11/2002 | Hu | |
| 2002/0166418 | A1 | 11/2002 | Hsieh | |
| 2002/0194950 | A1 | 12/2002 | Hu | |
| 2003/0010159 | A1 | 1/2003 | Hu | |
| 2003/0010163 | A1 | 1/2003 | Hu | |
| 2003/0012614 | A1 | 1/2003 | Hu | |
| 2003/0019335 | A1 | 1/2003 | Hu | |
| 2003/0070512 | A1 | 4/2003 | Hu | |
| 2003/0121373 | A1 | 7/2003 | Ling et al. | |
| 2003/0154826 | A1 | 8/2003 | Lee | |
| 2003/0196522 | A1 | 10/2003 | Hu | |
| 2004/0093995 | A1 | 5/2004 | Hu | |

FOREIGN PATENT DOCUMENTS

| | | |
|---|---|---|
| DE | 1810811 | 6/1970 |
| DE | 299 07 467 U1 | 9/1999 |
| DE | 299 10 932 U1 | 9/1999 |
| FR | 498276 | 1/1920 |
| GB | 1559093 | 1/1980 |
| GB | 2135226 | 8/1984 |
| TW | 130638 | 12/1977 |
| TW | 2122343 | 5/1983 |
| TW | 310649 | 1/1986 |

OTHER PUBLICATIONS

First Office Action on Patent Application No. 001003289 in People's Republic of China and Translation.

Office Action by Taiwan Intellectual Property Office on Opposition to Patent Application No. 089200570 in Taiwan and Translation; and Translations of Taiwanese Patent Publication No. 212343, of Taiwanese Patent Publication No. 310649, and of Taiwanese Patent Publication No. 130638 Abstracts only.

Decision by the Board of Appeal and Translation of same.

Taiwan Intellectual Property Office's Answer to Appeal Brief and Translation of same HU 051459.

Complaint for Declatory Judgment of Noninfringement, Unenforceability, and Invalidity of a Patent, dated Sep. 26, 2003.

Amended Complaint for Declatory Judgment of Noninfringement, Unenforceability, and Invalidity of a Patent, dated Sep. 19, 2003.

Plaintiff's Second Supplemental Response to Interrogatory No. 3 of Defendant's First Set of Interrogatories, dated Apr. 21, 2004.

* cited by examiner

REVERSIBLE RATCHETING TOOL WITH A SMALLER HEAD

CROSS REFERENCE TO RELATED APPLICATION

This is a continuation-in-part application of U.S. patent application Ser. No. 09/523,625 filed on Mar. 13, 2000, now U.S. Pat. No. 6,457,387.

BACKGROUND OF THE INVENTION

1. Field of the Invention

The present invention relates to a reversible ratcheting tool having a smaller head.

2. Description of the Related Art

A wide of variety of ratcheting tools have heretofore been disclosed, typical examples include: U.S. Pat. No. 1,957,462 to Kress issued on May 8, 1934; U.S. Pat. No. 4,328,720 to Shiel issued on May 11, 1982; U.S. Pat. No. 5,626,062 to Colvin issued on May 6, 1997; U.S. Pat. No. 4,762,033 to Chow issued on Aug. 9, 1988; U.S. Pat. No. 4,520,697 to Moetteli issued on Jun. 4, 1985; U.S. Pat. No. 3,337,014 to Sandrick issued on Aug. 22, 1967; and U.S. Pat. No. 5,144,869 to Chow issued on Sep. 8, 1992. Most of the above-mentioned conventional ratcheting tools fail to provide high torque operation, as the pawls merely engage with the ratchet wheel by at best three or five teeth. The head of the ratcheting tool has to be relatively large for accommodating those components and thus is difficult to be used in a limited space. In addition, the pawl is directly driven by the switch button or reverser plate or like element such that the pawl tends to be disengaged from the ratchet wheel or like element if the switch block is inadvertently impinged.

Applicant's U.S. Pat. No. 6,457,387 discloses a reversible ratcheting tool with a smaller head and improved driving torque to solve the above problems. The reversible ratcheting tool uses a spring for transmitting the switching force from the reversing plate to the pawl. However, the manufacture cost is high, the assembling procedure is complicated, and the risk of malfunction is high.

The present invention is intended to provide an improved design in this regard.

SUMMARY OF THE INVENTION

An object of the present invention is to provide a reversible ratcheting tool having a smaller head for convenient use in a limited space.

In accordance with a first aspect of the invention, a ratcheting tool comprises:

a handle;

a head extending from the handle and having a compartment therein, the head including a hole outside the compartment;

a drive member including a first end extending beyond the compartment, a second end, and a gear wheel formed between the first end and the second end, the gear wheel being rotatably mounted in the compartment and including an outer periphery with a plurality of teeth;

a pawl mounted in the compartment and including a first side facing the teeth of the gear wheel and a second side facing away from the gear wheel, the first side of the pawl including a plurality of teeth for engaging with the teeth of the gear wheel;

a switching plate mounted to the first end of the drive member and pivotable between a first position and a second position, the switching plate including a ring portion and a thumb piece extending from the ring portion, the ring portion defining a hole through which the first end of the drive member extends, the thumb piece including a groove in an underside thereof, a pin having a first end located in the groove of the thumb piece and a second end located in the hole of the head, the groove and the pin being so configured to allow pivotal movement of the switching plate relative to the pin, the thumb piece being operably connected to the pawl such that the pawl is moved when the thumb piece is turned and that the pawl is movable in a radial direction relative to the gear wheel; and means for retaining the switching plate in position.

In accordance with a second aspect of the invention, a ratcheting tool comprises:

a handle;

a head extending from the handle and having a compartment therein, the head including a hole outside the compartment;

a drive member including a first end extending beyond the compartment, a second end, and a gear wheel formed between the first end and the second end, the gear wheel being rotatably mounted in the compartment and including an outer periphery with a plurality of teeth, an annular groove being defined in a side of the gear wheel;

a pawl mounted in the compartment and including a first side facing the teeth of the gear wheel and a second side facing away from the gear wheel, the first side of the pawl including a plurality of teeth for engaging with the teeth of the gear wheel, the pawl further including a recess;

a ring mounted in the compartment and around the first end of the drive member, the ring including a tip piece engaged with the recess of the pawl such that the pawl is movable in a radial direction relative to the gear wheel, the ring including an engaging portion;

a switching plate mounted to the first end of the drive member and pivotable between a first position and a second position, the switching plate including a ring portion and a thumb piece extending from the ring portion, the ring portion defining a hole through which the first end of the drive member extends, the thumb piece including a groove in an underside thereof, a pin having a first end located in the groove of the thumb piece and a second end located in the hole of the head, the groove and the pin being so configured to allow pivotal movement of the switching plate relative to the pin, the thumb piece further including a protrusion on the underside thereof, the protrusion extending through the engaging portion of the ring into the annular groove of the gear wheel such that the pawl is moved when the thumb piece is turned; and means for retaining the switching plate in position.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
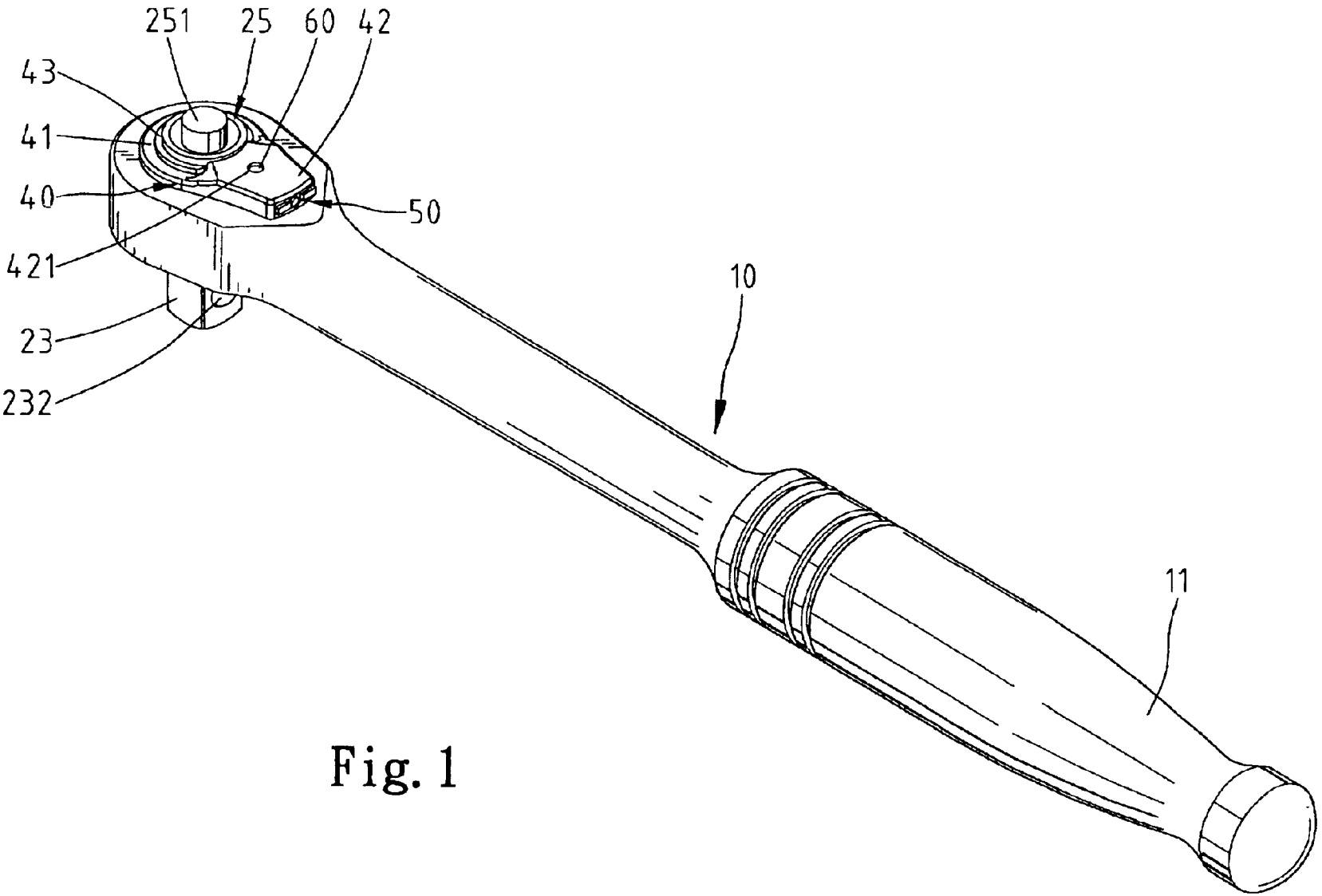
FIG. 1 is a perspective view of a reversible ratcheting tool in accordance with the present invention.
Figure 2:
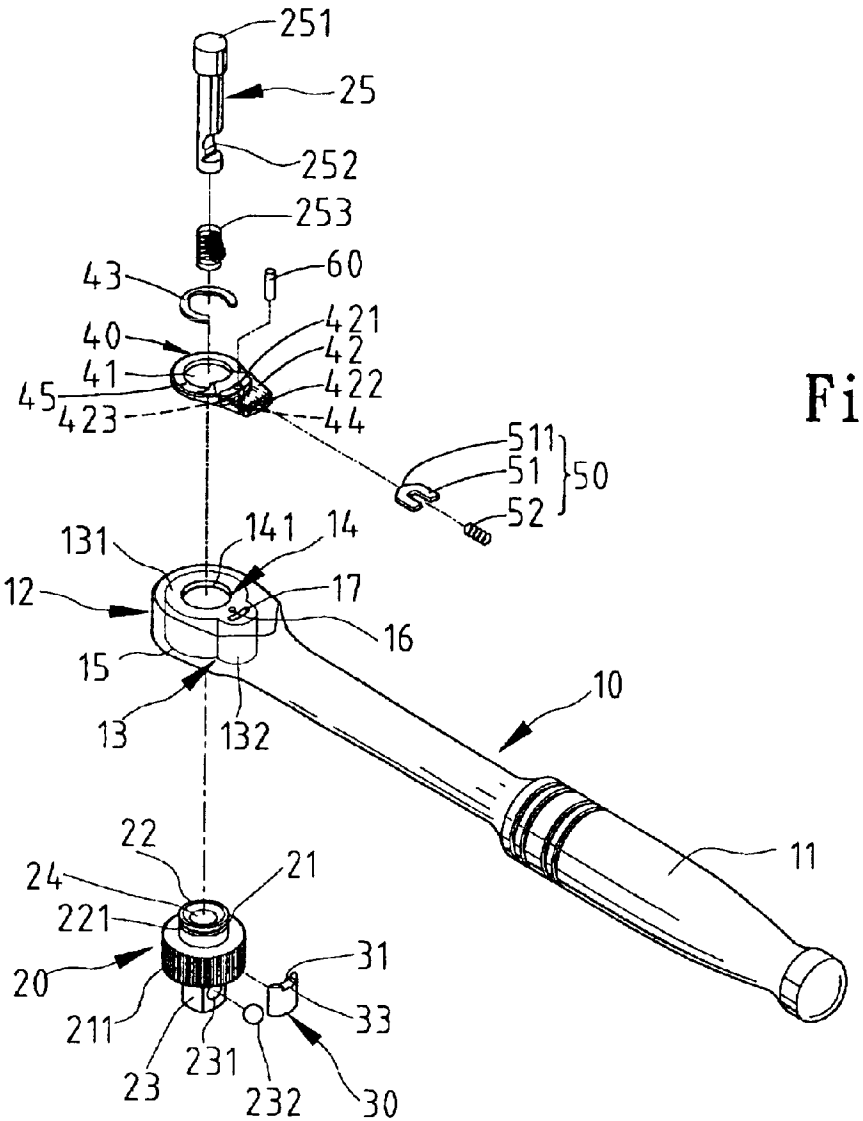
FIG. 2 is an exploded perspective view of the reversible ratcheting tool in FIG. 1.

Referring to FIGS. 1, 2, and 67 a ratcheting tool in accordance with the present invention is designated by 10 and has a handle 11 and a head 12 extended from the handle 11. The head 12 is substantially circular and has a minimized volume. The head 12 includes a compartment 13 consisting of a relatively larger first compartment section 131 and a relatively smaller second compartment section 132. A top face 14 of the head 12 includes an opening 141 that is preferably circular and concentric with the first compartment section 131. The top face 14 of the head 12 further includes a hole 16 and a slot 17 that are communicated with the second compartment section 132. Defined in a lower end of the head 12 is a circular hole 15 that is concentric with the first compartment section 131 and has a diameter the same as that of the first compartment section 131. The lower end of the head 12 is formed with a ledge 18 (FIG. 7) that defines a portion of the second compartment section 132.

Rotatably mounted in the head 12 is a drive member 20 having an upper end 22, a drive column 23 on a lower end thereof, and a gear wheel 21 formed in an intermediate portion thereof. The gear wheel 21 is rotatably received in the first compartment 131 of the head 12 and includes teeth 211 formed on an outer periphery thereof. The upper end 22 of the drive member 20 includes an engaging groove 221. The drive column 23 includes a hole 231 for receiving a ball 232. The drive member 20 further includes a central through-hole 24 that is communicated with the hole 231 and that has a shoulder portion 241, which will be described later.

Figure 7:
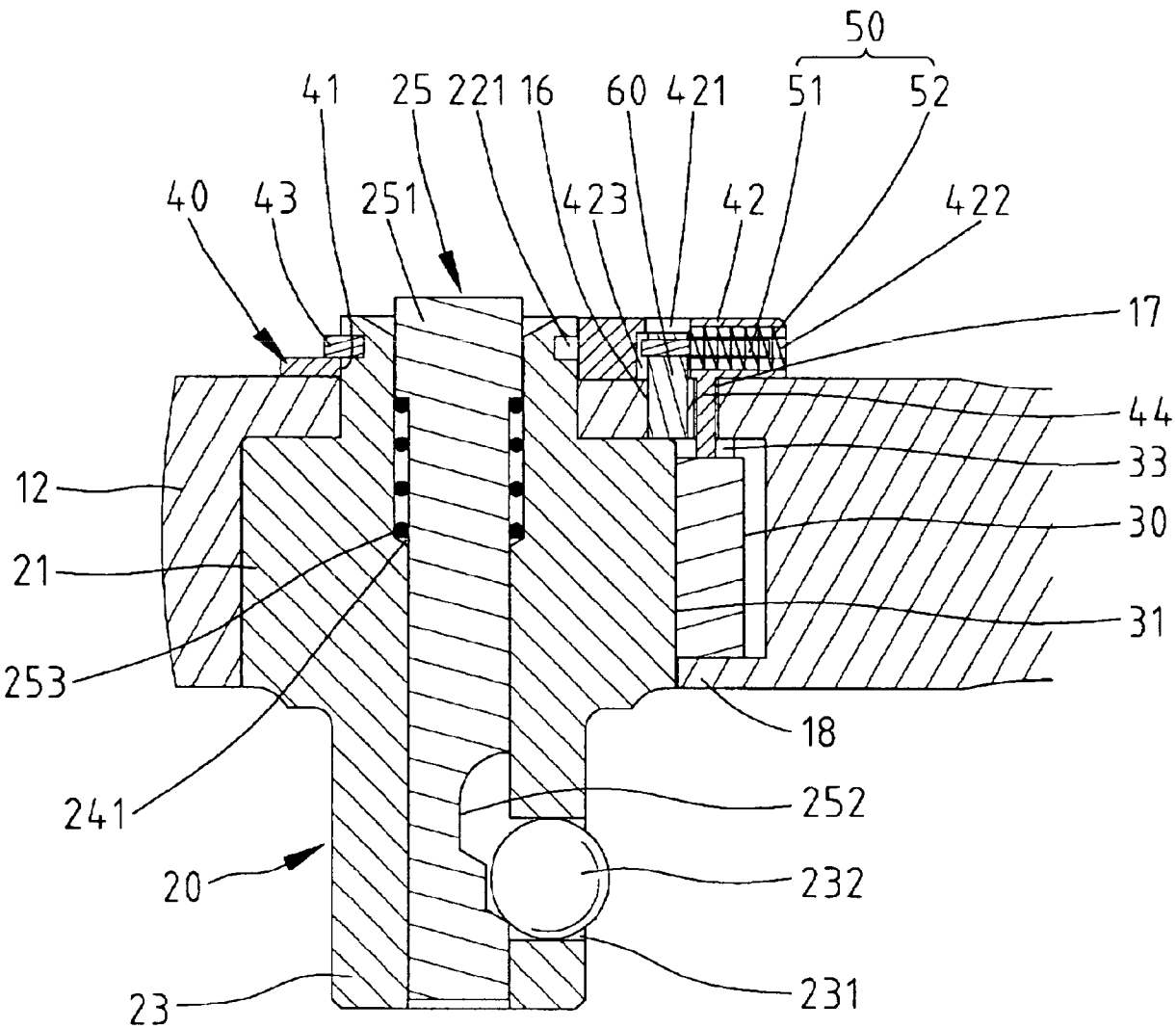
FIG. 7 is a sectional view taken along line 7–7 in FIG. 5.

Still referring to FIGS. 1, 2, and 7, a pushpin 25 is mounted in the through-hole 24 of the drive member 20 and includes an enlarged upper end 251 for manual pressing. A lower end of the pushpin 25 includes a stepped groove 252 for receiving a portion of the ball 232 when the pushpin 25 is pushed, thereby allowing disengagement of the drive column 23 from a socket (not shown). An elastic member 253 is mounted around the pushpin 25 and attached between the shoulder portion 241 of the through-hole 24 and the enlarged head 251 of the pushpin 25. The elastic member 253 biases the pushpin 25 upward for moving the ball 232 outward to an engaging position for engaging with a socket, which is conventional and therefore not further described. The ball 232 in the engaging position is engaged with the stepped groove 252 to thereby prevent disengagement of the pushpin 25.

A pawl 30 is mounted in the second compartment section 132 and includes a side facing the gear wheel teeth 211. Referring to FIG. 2A, the side of the pawl 30 has a plurality of teeth 31 for engaging with the gear wheel teeth 211. The pawl 30 further includes a recess 33 on a top thereof.

Figure 3:
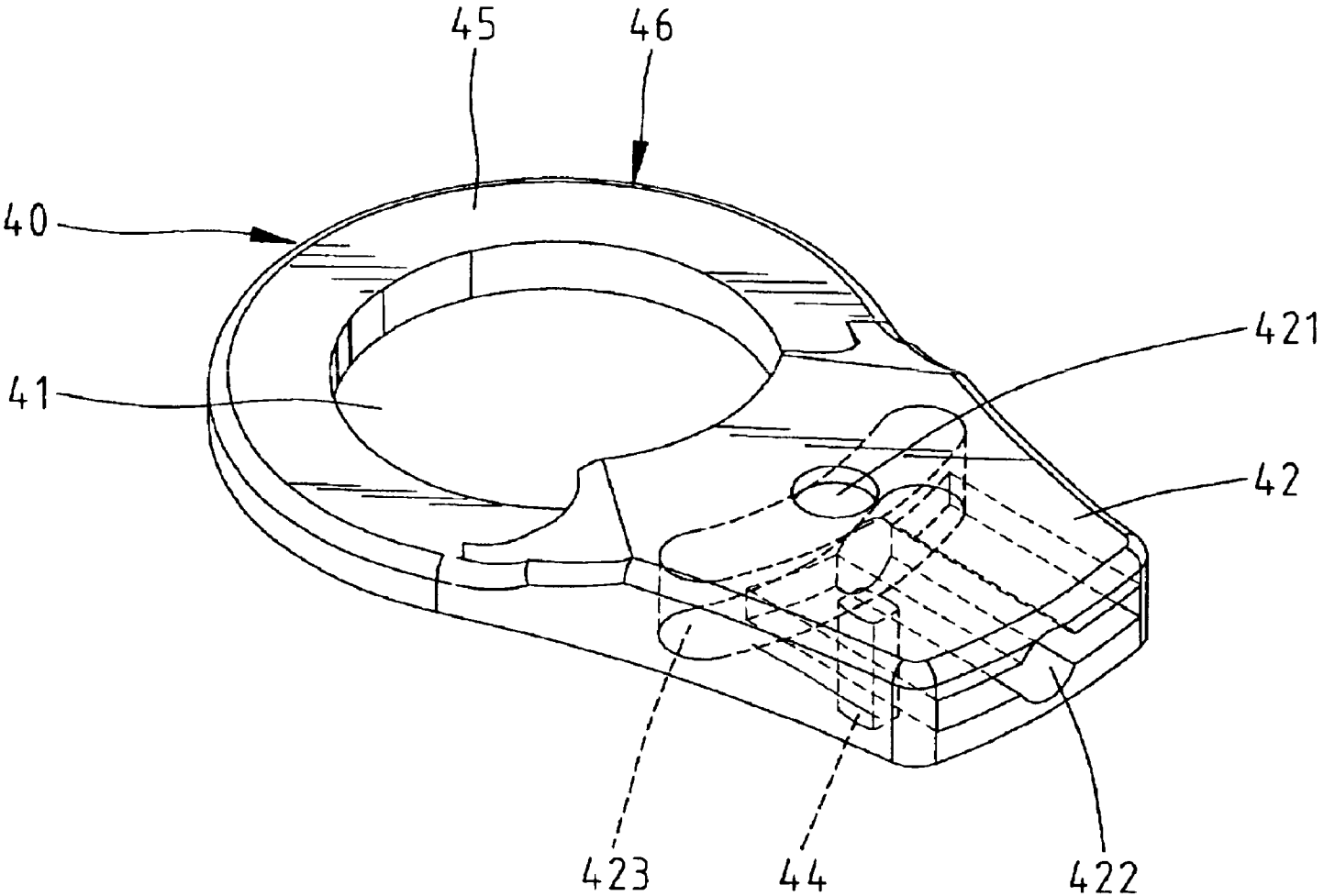
FIG. 3 is an enlarged perspective view illustrating a switching plate of the reversible ratcheting tool in accordance with the present invention.

A switching plate 40 is mounted around the upper end 22 of the drive member 20 and includes a ring portion 46 (FIG. 3) defining a hole 41 and a thumb piece 42 extending from the ring portion 46. As illustrated in FIG. 7, the enlarged head 251 of the pushpin 25 extends through the circular opening 141 of the head 12 and beyond the hole 41 of the switching plate 40 for manual operation. Referring to FIGS. 2 and 7, a retainer (e.g., a C-clip 43) is mounted on a recessed portion 45 on a top side of the ring portion 46 and partially engaged in the engaging groove 221 of the upper end 22 of the drive member 20, thereby retaining the upper end 22 of the drive member 20 to the top face 14 of the head 12. Thus, the switching plate 40 is pivotally mounted to the upper end 22 of the drive member 20.

The thumb piece 42 of the switching plate 40 further includes a through-hole 421. An arcuate groove 423 is defined in an underside of the thumb piece 42 and communicated with the through-hole 421. The thumb piece 42 further includes a receptacle 422 that is communicated with the arcuate groove 423. A protrusion 44 is formed on the underside of the thumb piece 42 and includes a lower end that extends through the slot 17 of the head 12 and is engaged in the recess 33 of the pawl 30. Thus, the pawl 30 is moved when the switching plate 40 is manually turned, thereby changing the ratcheting direction of the ratcheting tool.

A retaining means 50 is mounted in the receptacle 422 of the thumb piece 42 and includes a substantially U-shaped slide piece 51 and an elastic member 52. The slide piece 51 includes a tapered push-face 511 consisting of two faces (not labeled) separated by a tip (not labeled, see FIG. 2). The elastic member 52 is received between two limbs (not labeled) of the U-shaped slide piece 51. In practice, an end face of the receptacle 422 is pressed to form a configuration for preventing disengagement of the elastic member 52 from the receptacle 422 yet allowing movement of the slide piece 51 relative to the elastic member 52.

A pin 60 is passed through the through-hole 421 of the thumb piece 42 until a lower end of the pin 60 is located in the hole 16 of the head 12 and an upper end of the pin 60 is located in the arcuate groove 423 of the switching plate 40, best shown in FIG. 7. The lower end of the pin 60 rests on the upper side of the gear wheel 21. Thus, the pin 60 is retained in the hole 16. As a result, the arcuate groove 423 of the switching plate 40 is movable relative to the pin 60 during pivotal movement of the switching plate 40. The push-face 511 of the slide piece 51 may retain the pin 60 in place. Further, movement of the switching plate 40 other than the rotational direction is not possible due to provision of the pin 60. Further, the switching plate 40 is retained in place by the C-clip 43, thereby preventing disengagement of the switching plate 40 and the drive member 20.

Figure 5:
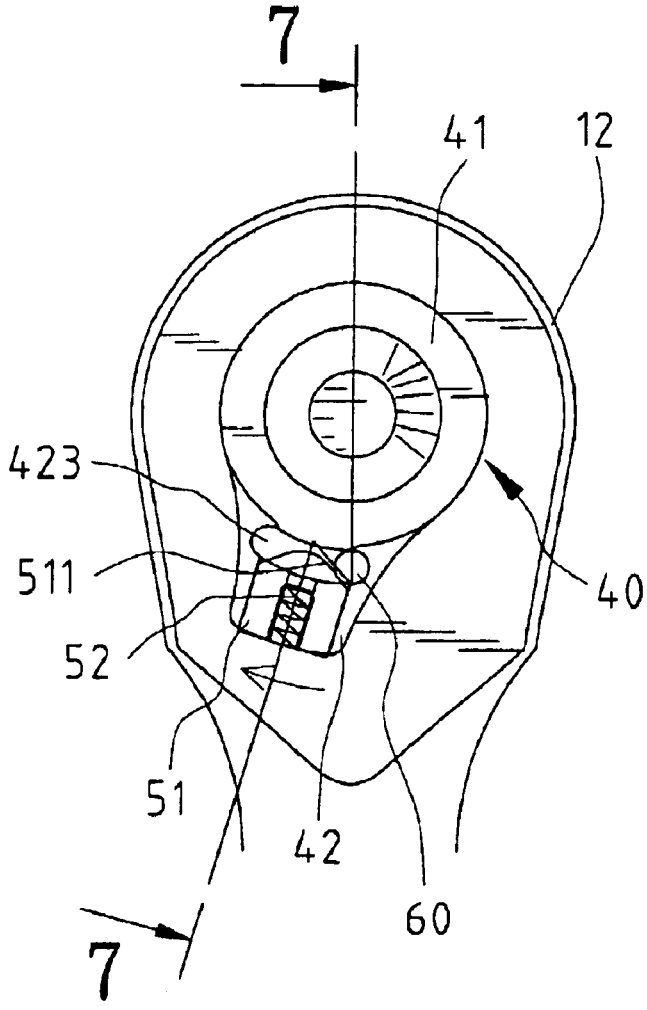
FIG. 5 is a top view similar to FIG. 4, wherein the reversible ratcheting tool is in a status allowing clockwise ratcheting.
Figure 5A:
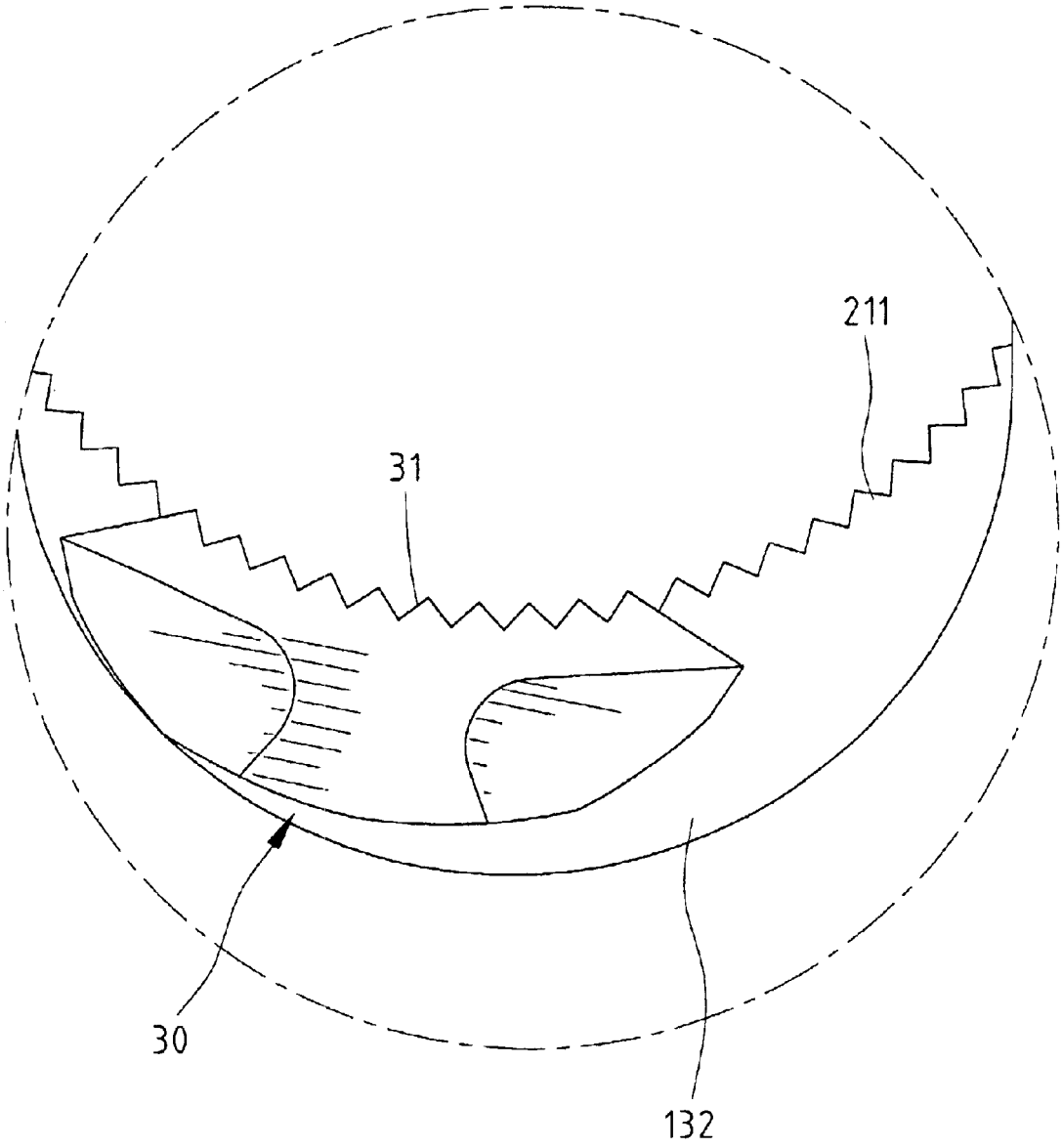
FIG. 5A is a view similar to FIG. 4A, wherein the ratcheting tool is in a status allowing clockwise ratcheting.

When the switching plate 40 is in a position shown in FIG. 5, a face of the push-face 511 of the slide piece 51 bears against the pin 60 under the action of the elastic member 52. The other side of the pawl 30 facing away from the teeth 31 bears against a wall portion defining the second compartment section 132, as shown in FIG. 5A. Thus, the teeth 31 of the pawl 30 are forced to engage with the teeth 211 of the gear wheel 21 of the drive member 20. The ratcheting tool is now in a status for driving a socket (not shown) or the like clockwise. The handle 11 of the ratcheting tool may be moved counterclockwise without disengaging the drive member 20 from the socket. Thus, the ratcheting tool may be used in a relatively small space, as the head 12 of the ratcheting tool is relatively small due to provision of the concentric design of the gear wheel 21 and the switching plate 40.

Figure 4:
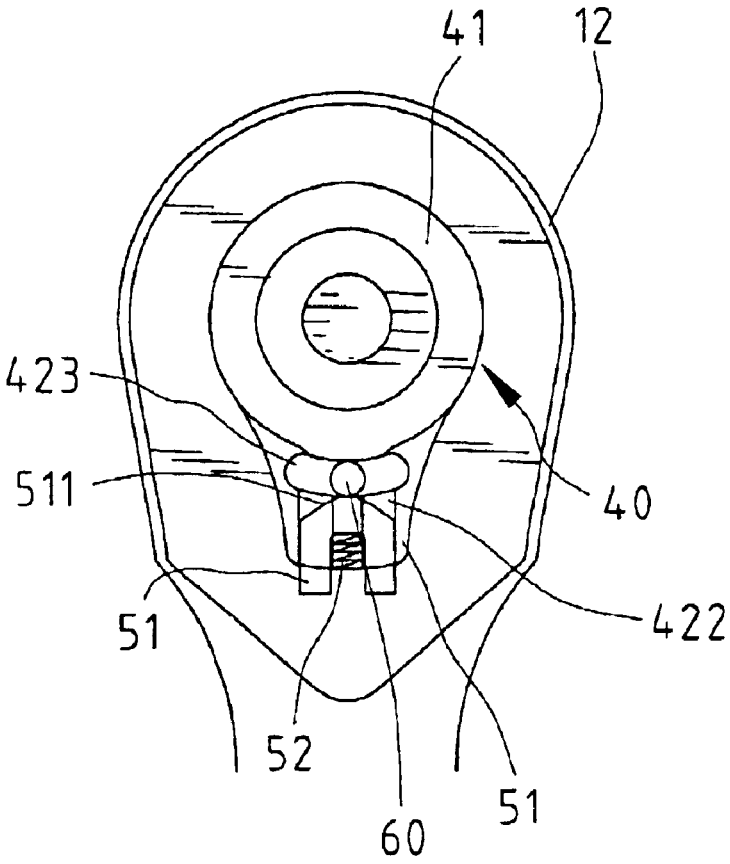
FIG. 4 is a top sectional view of an end portion of the reversible ratcheting tool in FIG. 1, wherein the ratcheting tool is in a status allowing free rotation.
Figure 4A:
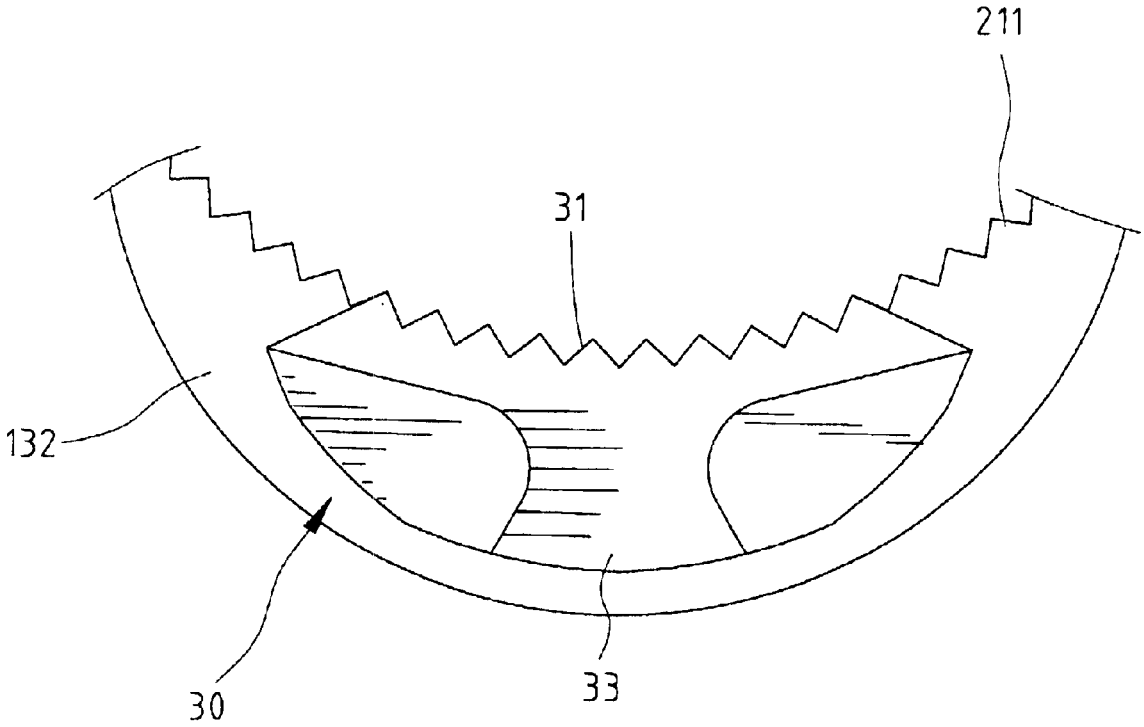
FIG. 4A is a schematic view, in an enlarged scale, illustrating engagement between a gear wheel and the pawl of the reversible ratcheting tool in accordance with the present invention, wherein the ratcheting tool is in a status allowing free rotation.

When the switching plate 40 is moved to a position shown in FIG. 4, the tip of the push-face 511 of the slide piece 51 bears against the pin 60 under the action of the elastic member 52. The pawl 30 is moved away from the gear wheel 21, as the protrusion 44 of the switching plate 40 is engaged in the recess 33 on the top face of the pawl 30. Thus, the pawl 30 is moved to a middle portion of the second compartment section 132 and thus disengaged from the teeth 211 of the gear wheel 21, as shown in FIG. 4A. As a result, the ratcheting tool is incapable of driving the socket.

Figure 6:
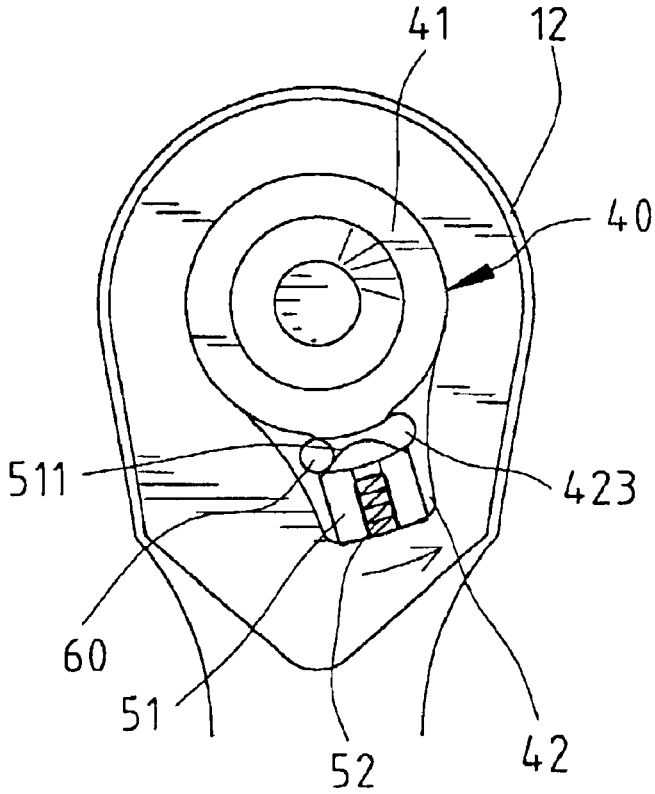
FIG. 6 is a sectional view similar to FIG. 4, wherein the reversible ratcheting tool is in a status allowing counterclockwise ratcheting.
Figure 6A:
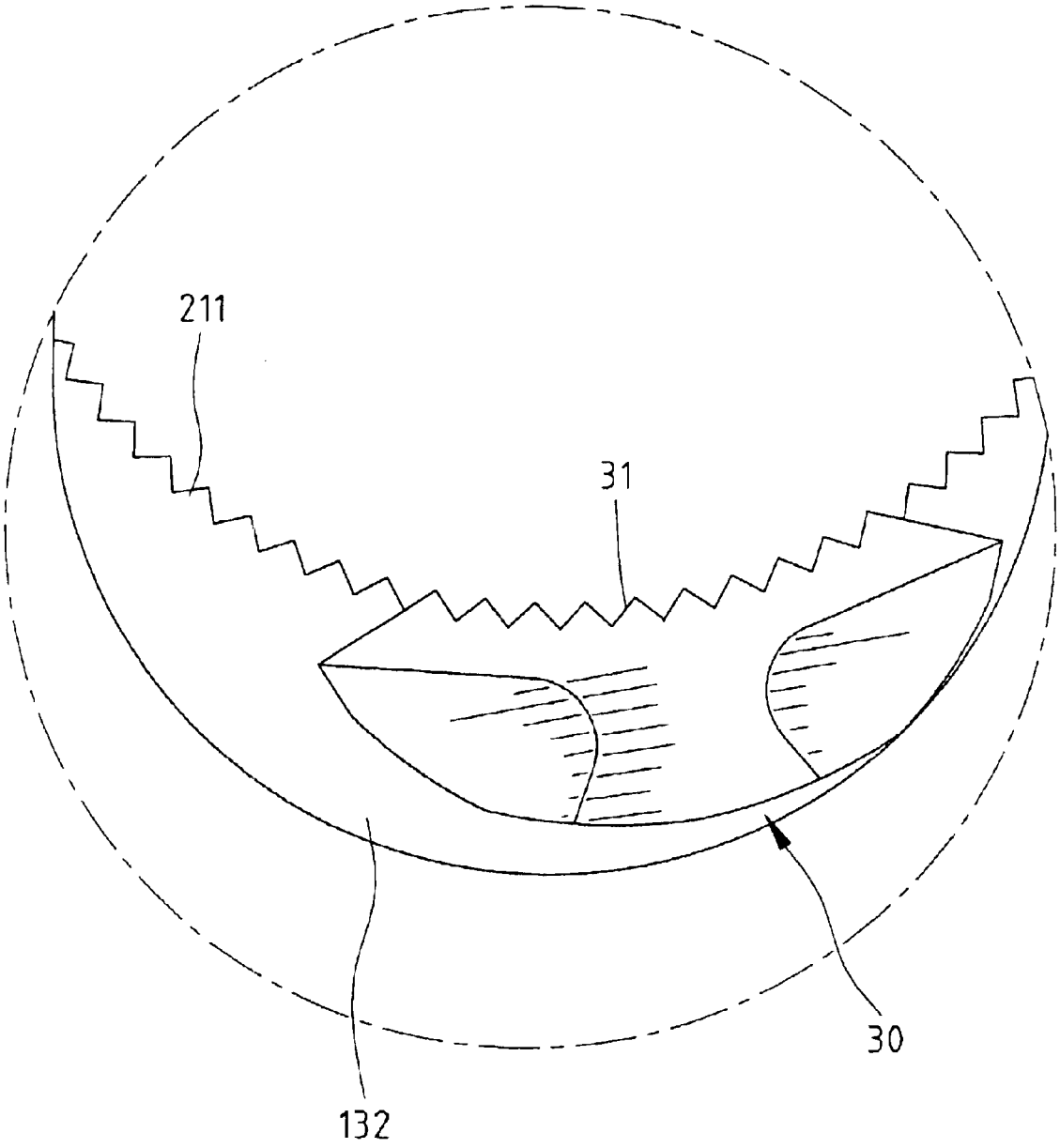
FIG. 6A is a view similar to FIG. 4A, wherein the ratcheting tool is in a status allowing counterclockwise ratcheting.

When the switching plate 40 is moved to a position shown in FIG. 6 by manually pushing the thumb piece 42, the slide piece 51 is moved away from the gear wheel 21 and compresses the elastic member 52. Thus, the pin 60 may slide over the push-face 511 of the slide piece 51 to the other face of the push-face 511. The other side of the pawl 30 facing away from the teeth 31 bears against another portion defining the second compartment section 132. Thus, the teeth 31 of the pawl 30 is forced to reengage with the teeth 211 of the gear wheel 21 of the drive member 20, as shown in FIG. 6A. The ratcheting tool is now in a status for driving the socket counterclockwise. It is appreciated that the pawl 30 is pivoted during pivotal movement of the thumb piece 42.

It is noted that the push-face 511 of the slide piece 51, under the action of the elastic member 52, retains the pin 60 as well as the pawl 30 in place to provide reliable ratcheting. Yet, the pin 60 and the recess 33 of the pawl 30 are configured to allow the pawl 30 to be moved away from the gear wheel 21 in a radial direction during non-driving rotation of the handle. Accordingly, the user must apply a relatively larger force to switch the switching plate 40, yet this prevents inadvertent impingement to the thumb piece 42 that may cause undesired movement of the pawl 30.

It is appreciated that the ratcheting tool in accordance with the present invention has a minimized head size that is very useful when operating in a limited space. This is owing to provision of the recess 45 on the ring portion 46 and the retainer (e.g., a C-clip 43) mounted on the recess 45. The overall thickness of the head 12 of the ratcheting tool is relatively small.

Figure 8:
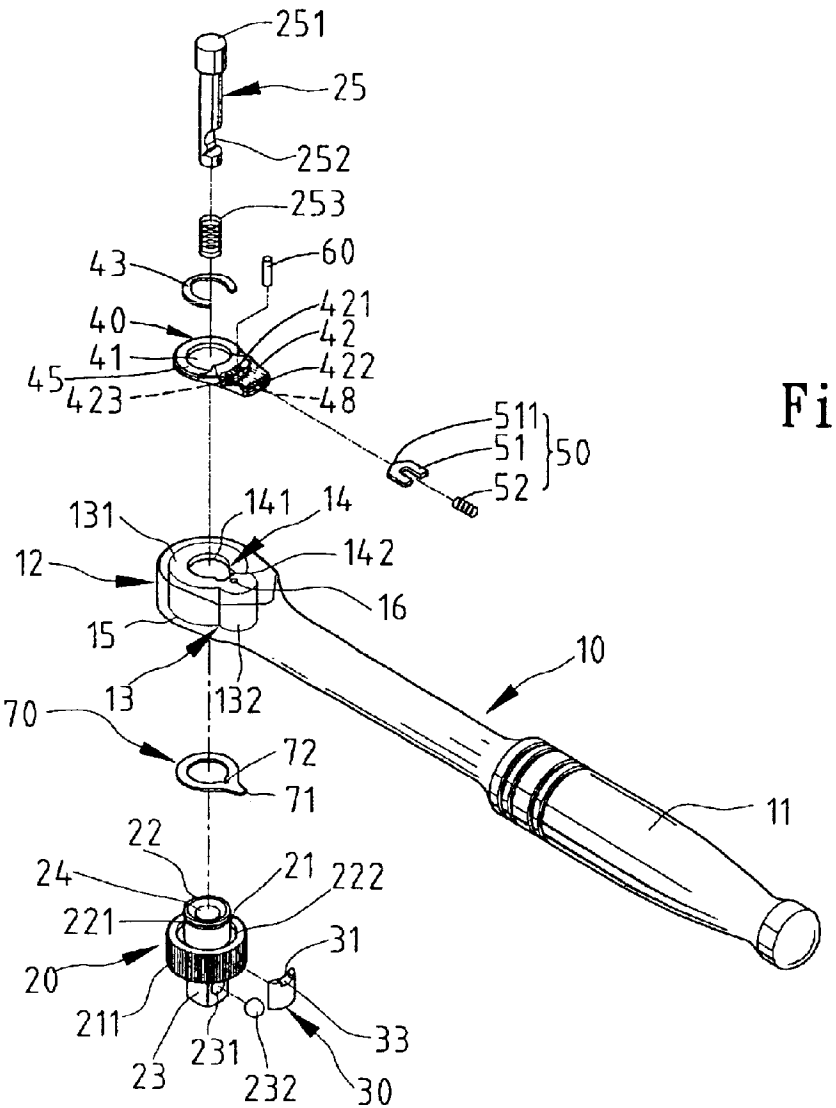
FIG. 8 is an exploded perspective view of a modified embodiment of the reversible ratcheting tool in accordance with the present invention.
Figure 9:
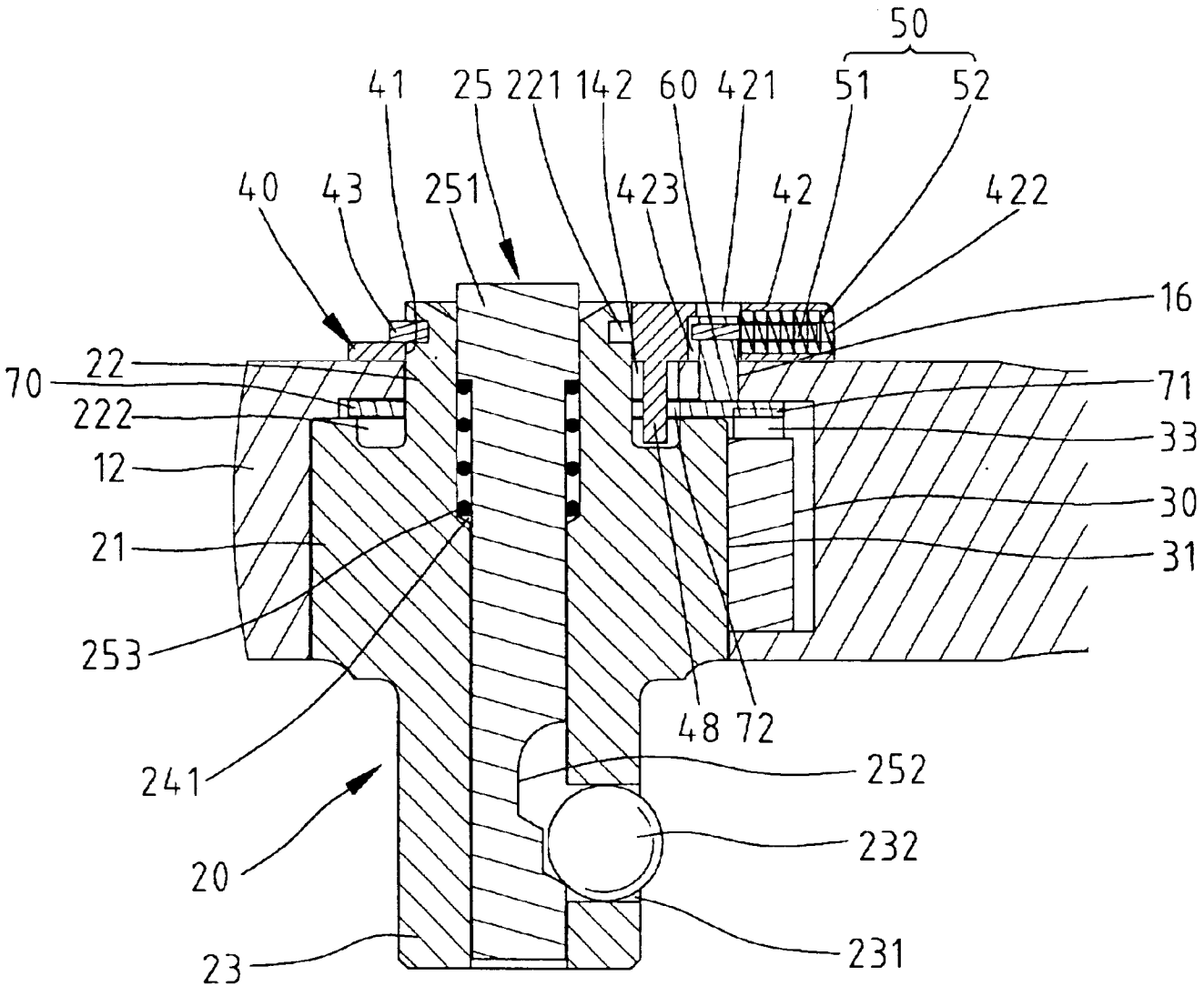
FIG. 9 is a sectional view of the reversible ratcheting tool in FIG. 8.

FIG. 8 illustrates a modified embodiment of the invention, wherein like elements denote like elements. In this embodiment, the slot 17 of the head 12 and the protrusion 44 of the switching plate 40 are omitted, and a protrusion 44 is formed on the underside of the thumb piece 42 and located between the hole 41 and the through-hole 421. An annular groove 222 is defined in a side of the gear wheel 21. The opening 141 includes a rectangular extension 142 that is located adjacent to the hole 16 of the head 12. A ring 70 is pivotally mounted around the upper end 22 of the drive member 20. A tip piece 71 projects outward from the ring 70 and is engaged in the recess 33 of the pawl 30 to move therewith. An engaging portion (e.g., a notch 72) is defined in an inner periphery of the ring 70 and aligned with the annular groove 222 of the drive member 20. The protrusion 44 of the switching plate 40 is extended through the extension 142 of the opening 141 and the notch 72 of the ring 70 and into the annular groove 222 of the gear wheel 21. Thus, when the switching plate 40 is turned, the pawl 30 is moved via transmission of the protrusion 44 and the ring 70.

It is noted that the push-face 511 of the slide piece 51, under the action of the elastic member 52, retains the ring 70 as well as the pawl 30 in place to provide reliable ratcheting. Yet, the tip piece 71 of the ring 70 and the recess 33 of the pawl 30 are configured to allow the pawl 30 to be moved away from the gear wheel 21 in a radial direction during non-driving rotation of the handle. Accordingly, the user must apply a relatively larger force to switch the switching plate 40, yet this prevents inadvertent impingement to the thumb piece 42 that may cause undesired movement of the pawl 30.

According to the above description, it is appreciated that the ratcheting tool in accordance with the present invention has a minimized head size that is very useful when operating in a limited space. This is owing to provision of the recess 45 on the ring portion 46 and the retainer (e.g., a C-clip 43) mounted on the recess 45. The overall thickness of the head 12 of the ratcheting tool is relatively small. In addition, the ratcheting direction can be changed by easy operation of the switching plate 40. The arrangement for achieving the ratcheting direction switching is simple yet requires a relatively larger force to prevent inadvertent switching. The structure of the reversible ratcheting tool in accordance with the present invention is reliable. The manufacture cost is low, the assembling procedure is simple, and the risk of malfunction is low.

Although the invention has been explained in relation to its preferred embodiments, it is to be understood that many other possible modifications and variations can be made without departing from the spirit and scope of the invention as hereinafter claimed.

What is claimed is:

1. A ratcheting tool comprising:

a handle;

a head extending from the handle and having a compartment therein, the head including a hole outside the compartment;

a drive member including a first end extending beyond the compartment, a second end, and a gear wheel formed between the first end and the second end, the gear wheel being rotatably mounted in the compartment and including an outer periphery with a plurality of teeth;

a pawl mounted in the compartment and including a first side facing the teeth of the gear wheel and a second side facing away from the gear wheel, the first side of the pawl including a plurality of teeth for engaging with the teeth of the gear wheel;

a switching plate mounted to the first end of the drive member and pivotable between a first position and a second position, the switching plate including a ring portion and a thumb piece extending from the ring portion, the ring portion defining a hole through which the first end of the drive member extends, the thumb piece including a groove in an underside thereof, a pin having a first end located in the groove of the thumb piece and a second end located in the hole of the head, the groove and the pin being so configured to allow pivotal movement of the switching plate relative to the pin, the thumb piece being operably connected to the pawl such that the pawl is moved when the thumb piece is turned and that the pawl is movable in a radial direction relative to the gear wheel; and means for retaining the switching plate in position.

2. The ratcheting tool as claimed in claim 1, wherein the head further includes a top face with an opening, and wherein the first end of the drive member is extended beyond the opening.

3. The ratcheting tool as claimed in claim 1, wherein the second end of the drive member is a drive column for releasably engaging with a socket.

4. The ratcheting tool as claimed in claim 1, wherein the thumb piece of the switching plate further includes a receptacle communicated with the groove, the retaining means being mounted in the receptacle and including a slide piece and an elastic member for biasing the slide piece toward the pin.

5. The ratcheting tool as claimed in claim 4, wherein the slide piece includes a tapered push-face consisting of two faces separated by a tip, the push-face of the slide piece being extended into the groove of the switching plate, wherein one of the faces bears against the pin when the switching plate is in its first position to thereby retain the pawl in its first ratcheting position, and wherein the other face of the slide piece bears against the pin when the switching plate in its second position to thereby retain the pawl in its second ratcheting position, the slide piece being slidable relative to the elastic member and biased toward the pin by the elastic member.

6. The ratcheting tool as claimed in claim 4, wherein the slide piece is U-shaped and has two limbs, and wherein the elastic member is mounted between the limbs of the slide piece.

7. The ratcheting tool as claimed in claim 1, wherein the thumb piece includes a through-hole communicated with the groove and aligned with the hole of the head, thereby allowing insertion of the pin through the through-hole.

8. The ratcheting tool as claimed in claim 1, wherein the pawl further includes a recess, the thumb piece further including a protrusion on an underside thereof, the protrusion being engaged in the recess of the pawl.

9. The ratcheting tool as claimed in claim 8, wherein the head further including a top face having a slot through which the protrusion of the switching plate extends.

10. The ratcheting tool as claimed in claim 1, wherein the second end of the drive member is outside the compartment of the head.

11. The ratcheting tool as claimed in claim 1, wherein the first end of the drive member includes an engaging groove, further including a retainer mounted on the ring portion of the switching plate and partially engaged in the engaging groove of the first end of the drive member.

12. The ratcheting tool as claimed in claim 11, wherein the ring portion of the switching plate includes a recessed portion on which the retainer is mounted, thereby reducing an overall thickness of the head.

13. A ratcheting tool comprising:

a handle;

a head extending from the handle and having a compartment therein, the head including a hole outside the compartment;

a drive member including a first end extending beyond the compartment, a second end, and a gear wheel formed between the first end and the second end, the gear wheel being rotatably mounted in the compartment and including an outer periphery with a plurality of teeth, an annular groove being defined in a side of the gear wheel;

a pawl mounted in the compartment and including a first side facing the teeth of the gear wheel and a second side facing away from the gear wheel, the first side of the pawl including a plurality of teeth for engaging with the teeth of the gear wheel, the pawl further including a recess;

a ring mounted in the compartment and around the first end of the drive member, the ring including a tip piece engaged with the recess of the pawl such that the pawl is movable in a radial direction relative to the gear wheel, the ring including an engaging portion;

a switching plate mounted to the first end of the drive member and pivotable between a first position and a second position, the switching plate including a ring portion and a thumb piece extending from the ring portion, the ring portion defining a hole through which the first end of the drive member extends, the thumb piece including a groove in an underside thereof, a pin having a first end located in the groove of the thumb piece and a second end located in the hole of the head, the groove and the pin being so configured to allow pivotal movement of the switching plate relative to the pin, the thumb piece further including a protrusion on the underside thereof, the protrusion extending through the engaging portion of the ring into the annular groove of the gear wheel such that the pawl is moved when the thumb piece is turned; and means for retaining the switching plate in position.

14. The ratcheting tool as claimed in claim 13, wherein the head further includes a top face with a circular opening having an extension, and wherein the first end of the drive member is extended beyond the opening.

15. The ratcheting tool as claimed in claim 13, wherein the second end of the drive member is a drive column for releasably engaging with a socket.

16. The ratcheting tool as claimed in claim 13, wherein the thumb piece of the switching plate further includes a receptacle communicated with the groove, the retaining means being mounted in the receptacle and including a slide piece and an elastic member for biasing the slide piece toward the pin.

17. The ratcheting tool as claimed in claim 16, wherein the slide piece includes a tapered push-face consisting of two faces separated by a tip, the push-face of the slide piece being extended into the groove of the switching plate, wherein one of the faces bears against the pin when the switching plate is in its first position to thereby retain the pawl in its first ratcheting position, and wherein the other face of the slide piece bears against the pin when the switching plate in its second position to thereby retain the pawl in its second ratcheting position, the slide piece being slidable relative to the elastic member and biased toward the pin by the elastic member.

18. The ratcheting tool as claimed in claim 16, wherein the slide piece is U-shaped and has two limbs, and wherein the elastic member is mounted between the limbs of the slide piece.

19. The ratcheting tool as claimed in claim 13, wherein the thumb piece includes a through-hole communicated with the groove and aligned with the hole of the head, thereby allowing insertion of the pin through the through-hole.

20. The ratcheting tool as claimed in claim 14, wherein the protrusion of the switching plate is extended through the extension of the opening.

21. The ratcheting tool as claimed in claim 13, wherein the engaging portion of the ring is a notch.

22. The ratcheting tool as claimed in claim 13, wherein the second end of the drive member is outside the compartment of the head.

23. The ratcheting tool as claimed in claim 13, wherein the first end of the drive member includes an engaging groove, further including a retainer mounted on the ring portion of the switching plate and partially engaged in the engaging groove of the first end of the drive member.

24. The ratcheting tool as claimed in claim 23, wherein the ring portion of the switching plate includes a recessed portion on which the retainer is mounted, thereby reducing an overall thickness of the head.

* * * * *